US008764218B2

(12) United States Patent
Yeh

(10) Patent No.: US 8,764,218 B2
(45) Date of Patent: Jul. 1, 2014

(54) ILLUMINATION ALERT APPARATUS STRUCTURE HAVING CAP FOR USE IN SWITCH CONTROL

(75) Inventor: Hsueh-Chu Yeh, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 447 days.

(21) Appl. No.: 13/310,850

(22) Filed: Dec. 5, 2011

(65) Prior Publication Data

US 2013/0141214 A1 Jun. 6, 2013

(30) Foreign Application Priority Data

Dec. 2, 2011 (TW) ..... 100222851 U

(51) Int. Cl.
*F21L 19/00* (2006.01)

(52) U.S. Cl.
USPC ..... 362/178; 362/202; 362/188; 362/197; 340/6.1

(58) Field of Classification Search
CPC .... B25B 15/02; F21V 23/0414; F21V 210/02
USPC ..... 362/178, 188, 202, 197; 340/6.1
See application file for complete search history.

(56) References Cited

U.S. PATENT DOCUMENTS

| | | | | |
|---|---|---|---|---|
| 7,866,839 | B2 * | 1/2011 | Chien | 362/119 |
| 2004/0111950 | A1 * | 6/2004 | Lindgren | 43/17.5 |
| 2005/0254234 | A1 * | 11/2005 | Wang | 362/184 |
| 2010/0296271 | A1 * | 11/2010 | Chien | 362/119 |

* cited by examiner

*Primary Examiner* — Steven Lim
*Assistant Examiner* — Omeed Alizada
(74) *Attorney, Agent, or Firm* — Alan D. Kamrath; Kamrath IP Lawfirm, P.A.

(57) ABSTRACT

The present invention provides an illumination alert apparatus structure having a cap for use in switch control. The illumination alert apparatus which is illumination-oriented comprises a body, a power unit, and a lightbulb having an illumination unit coupled thereto. The power unit is coupled to an end of the body. The lightbulb is screwed to an external thread formed on an outward side of the body and coupled to the power unit, so as to assemble the illumination alert apparatus. The illumination alert apparatus structure dispenses with other switch-related components which might otherwise compromise the overall esthetical appearance of the illumination alert apparatus, such that the illumination alert apparatus manifests simplicity, beauty, and novelty.

4 Claims, 5 Drawing Sheets

ILLUMINATION ALERT APPARATUS STRUCTURE HAVING CAP FOR USE IN SWITCH CONTROL

FIELD OF THE INVENTION

The present invention relates to illumination alert apparatus structures each having a cap for use in switch control, and more particularly, to an illumination alert apparatus structure having a cap for use in switch control and capable of dispensing with other switch-related components which might otherwise compromise the overall esthetical appearance of the illumination alert apparatus, such that the illumination alert apparatus manifests simplicity, beauty, and novelty.

BACKGROUND OF THE INVENTION

At present, illumination alert apparatuses designed by the industrial sector come in diverse shapes. However, to suit conventional usage-related reasoning models, it is necessary for the illumination alert apparatuses to be equipped with additional buttons for controlling the ON state and OFF state of the illumination alert apparatuses. Doing so accounts for known drawbacks of the illumination alert apparatuses as follows: a lack of integrity of appearance; incurred additional costs; invasion of foreign bodies; susceptibility to weather changes; invasion of moisture; and poor electrical contact of a switch. The aforesaid drawbacks of the illumination alert apparatuses compromise the operation and use thereof.

SUMMARY OF THE INVENTION

To improve on the existing illumination-oriented illumination alert apparatuses which are necessarily equipped with additional buttons for controlling the ON state and OFF state of the illumination alert apparatuses and therefore have drawbacks as follows: a lack of integrity of appearance; incurred additional costs; susceptibility to weather changes; invasion of moisture; and poor electrical contact of a switch. The aforesaid drawbacks of the illumination alert apparatuses render it inconvenient to operate the illumination alert apparatuses.

It is a primary objective of the present invention to provide an illumination alert apparatus. The illumination alert apparatus comprises a body, a power unit, and a lightbulb having an illumination unit coupled thereto. The body has one end coupled to a power unit, wherein the lightbulb is screwed to an external thread formed on an outward side of the body and positioned proximate to the power unit so as to form an illumination alert apparatus structure having a cap for controllably driving the illumination unit to be on or off.

The second objective of the present invention is to provide the illumination alert apparatus, wherein the body of the illumination alert apparatus has one end coupled to the power unit. The power unit comprises a battery holder and a battery lid. The battery holder receives a plurality of batteries. The battery lid is engageable with one end of the battery holder. A preset orientation hole is penetratingly formed in the battery lid to allow positive and negative pole conductive rods to extend into the preset orientation hole. Springs abut against the other ends of the positive and negative pole conductive rods, respectively. The active ends of the springs abutting against the positive and negative pole conductive rods rest upon conductive elements of the battery holder, respectively. The battery lid is fixed to the battery holder by at least one support element. A stop portion protrudes from the outer rim of the battery lid, such that the stop portion abuts against an O-ring coupled to the inside of a middle annular cover at the bottom of the lightbulb to prevent the power unit coupled to one end of the body from rotating.

The third objective of the present invention is to provide the illumination alert apparatus, wherein the lightbulb screwed to the external thread formed on an outward side of the body and coupled to the power unit comprises a cap, a cup nested in the cap, and a plate. A copper sheet is coupled to a preset position on the active side of the plate. The illumination unit is centrally disposed at the plate. A plurality of notches are disposed at rims of the plate and the cup and spaced apart, respectively, such that protrusion portions disposed at the rim of the cap can be inserted into the notches during an assembly process. A flange is formed at an end of the cap for allowing the O-ring to be fixed in place. The flange of the cap is inserted into a middle opening at a corresponding end of the middle annular cover. Orientation of the O-ring coupled to the end of the cap is subjected to restriction imposed by an inner margin of the middle opening of the middle annular cover. A thread segment disposed on the inner wall of the middle annular cover is meshed with the external thread formed on an outward side of the body to enable engagement between the lightbulb and the body.

The fourth objective of the present invention is to provide the illumination alert apparatus, wherein the lightbulb coupled to the external thread formed on the outward side of the body and coupled to the power unit is rotated to controllably turn on or turn off the power unit, by rotating the cap of the lightbulb to drive the plate internally coupled thereto to undergo angular displacement, such that the copper sheet on an active side of the plate produces a power electrical connection ON state to turn on the illumination unit as soon as the copper sheet rotates and reaches the negative pole conductive rod of the power unit. Alternatively, the copper sheet on the active side of the plate is separated from the negative pole conductive rod of the power unit, thereby bringing about a power electrical connection OFF state to turn off the illumination unit.

The fifth objective of the present invention is to provide the illumination alert apparatus, wherein, to remove the lightbulb coupled to the external thread formed on an outward side of the body and coupled to the power unit of the illumination alert apparatus, it is only necessary to rotate the middle annular cover at the bottom of the lightbulb, such that the lightbulb is separated from the corresponding end of the body of the illumination alert apparatus, and the batteries in the battery holder can be changed.

DETAILED DESCRIPTION OF THE EMBODIMENTS OF THE INVENTION

Figure 1:
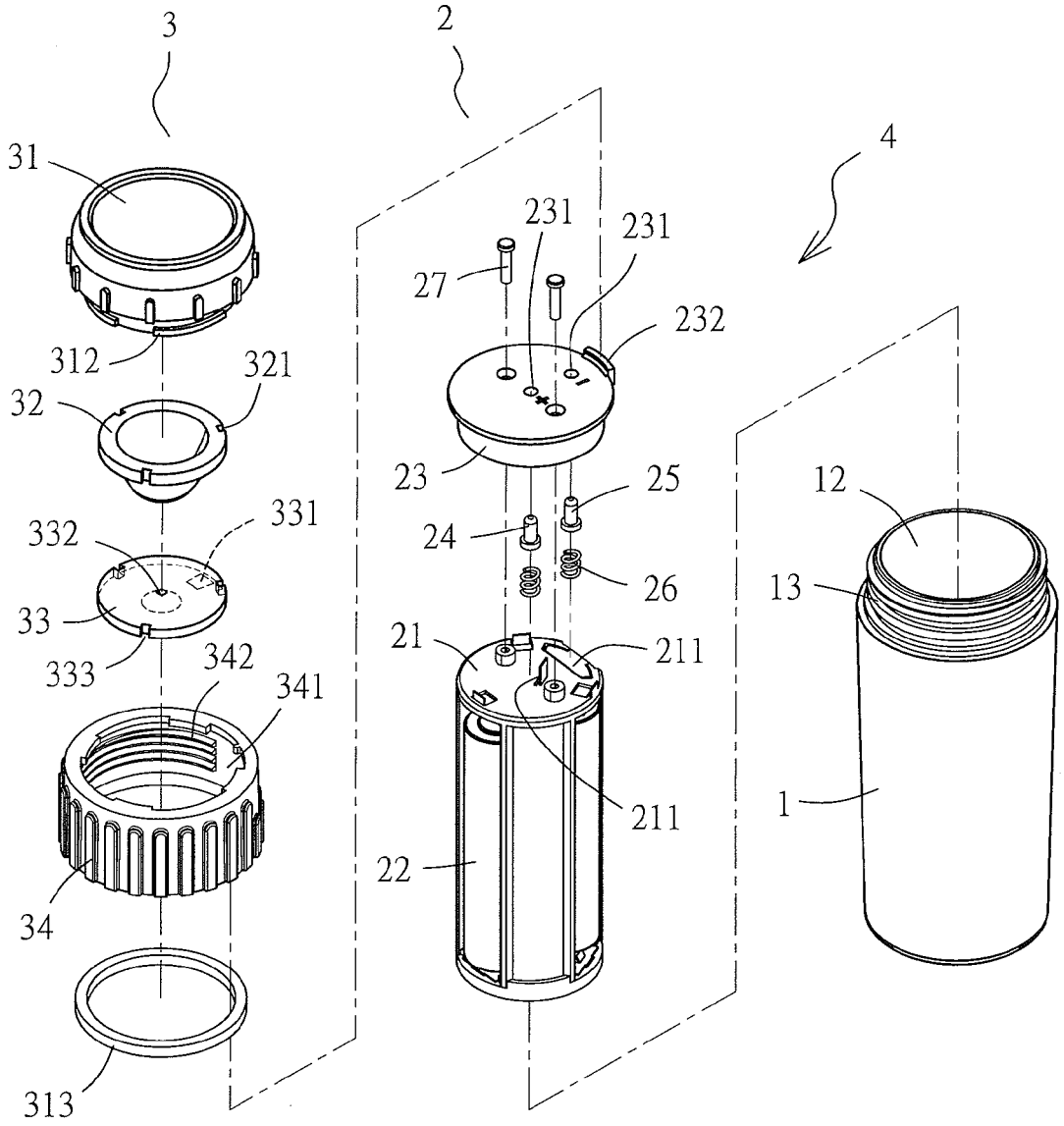
FIG. 1 is an exploded schematic view of an illumination alert apparatus of the present invention.

The present invention provides an illumination alert apparatus structure having a cap for use in switch control, as shown in FIG. 1. The illumination alert apparatus 4 which is illumination-oriented comprises a body 1, a power unit 2, and a lightbulb 3 having an illumination unit 332 coupled thereto.

The body 1 has one end formed with a coupling space 12 for receiving the power unit 2. An external thread 13 is formed on an outward side of the coupling space 12 of the body 1.

Figure 3:
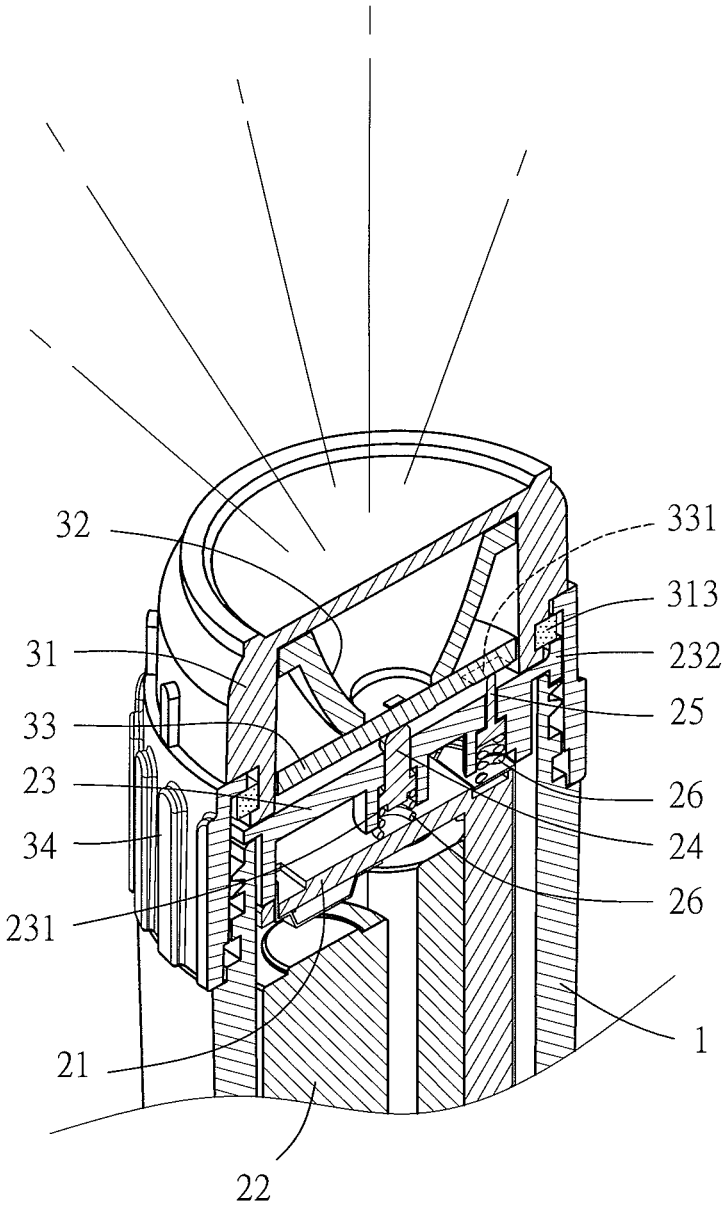
FIG. 3 is a partial cross-sectional schematic view of the illumination alert apparatus electrically turned on according to the present invention.

The power unit 2 is a power supply assembly selectively received in the coupling space 12 of the body 1. The power unit 2 comprises a battery holder 21 for holding a plurality of batteries 22, and a battery lid 23 engageable with one end of the battery holder 21, as shown in FIGS. 1, 3. A preset orientation hole 231 is penetratingly formed in the battery lid 23 to allow positive and negative pole conductive rods 24, 25 to extend into the preset orientation hole 231. Springs 26 abut against the other ends of the positive and negative pole conductive rods 24, 25, respectively. The active ends of the springs 26 abutting against the positive and negative pole conductive rods 24, 25 rest upon conductive elements 211 of the battery holder 21, respectively. The battery lid 23 is fixed to the battery holder 21 by at least one support element 27. A stop portion 232 protrudes from the outer rim of the battery lid 23, such that the stop portion 232 abuts against an O-ring 313 coupled to the inside of a middle annular cover 34 at the bottom of the lightbulb 3 to prevent the power unit 2 coupled to one end of the body 1 from rotating.

The lightbulb 3 has an illumination unit corresponding in position to the external thread 13 at one end of the body 1 and the power unit 2 coupled thereto. The lightbulb 3 comprises a cap 31, a cup 32 nested in the cap 31, and a plate 33. A copper sheet 331 is coupled to a preset position on the active side of the plate 33, and the illumination unit 332 is centrally disposed at the plate 33. The illumination unit 332 is implemented by an LED. A plurality of notches 333, 321 are disposed at the rims of the plate 33 and the cup 32 and spaced apart, respectively, such that protrusion portions 311 (see FIGS. 1, 4, 6) disposed at the rim of the cap 31 can be inserted into the notches 333, 321 during an assembly process. A flange 312 is formed at the end of the cap 31 for allowing the O-ring 313 to be fixed in place, as shown in FIGS. 1, 3. The flange 312 of the cap 31 is inserted into a middle opening 341 at a corresponding end of the middle annular cover 34. The orientation of the O-ring 313 coupled to the end of the cap 31 is subjected to the restriction imposed by the inner margin of the middle opening 341 of the middle annular cover 34. A thread segment 342 is disposed on the inner wall of the middle annular cover 34. The thread segment 342 is meshed with the external thread 13 formed on an outward side of the body 1 to enable engagement between the lightbulb 3 and the body 1.

Figure 2:
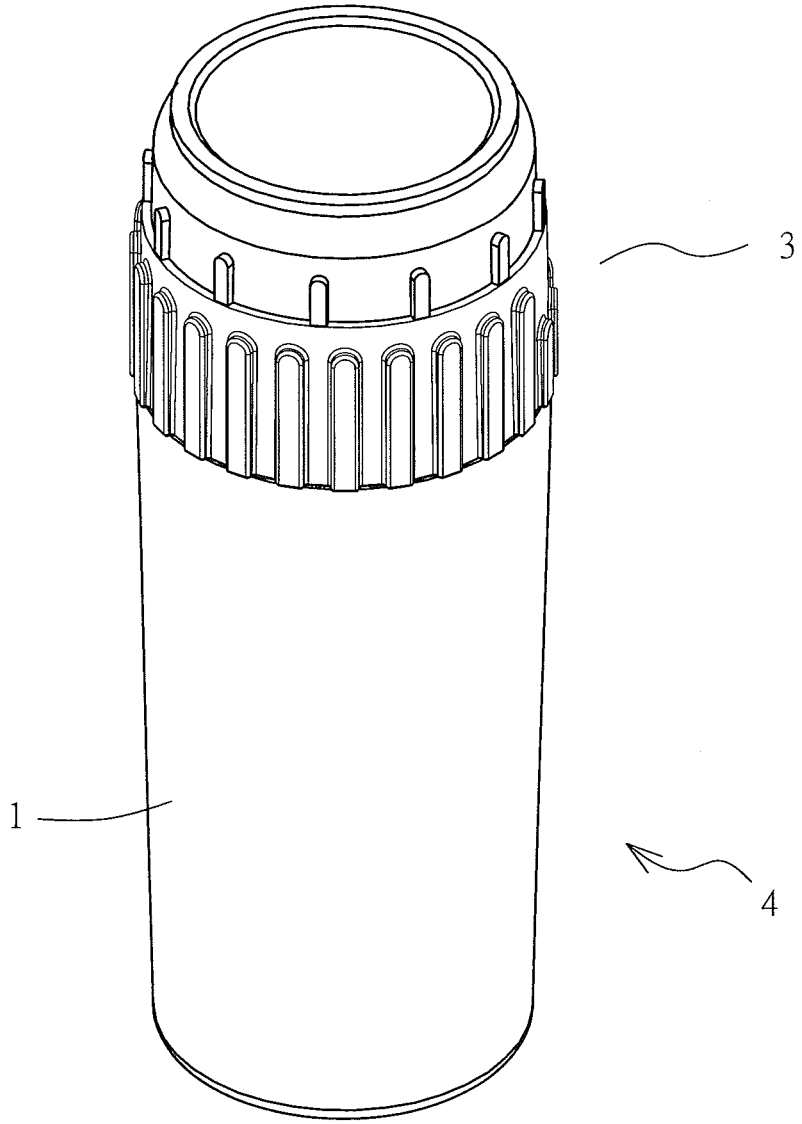
FIG. 2 is a perspective schematic view of the illumination alert apparatus assembled according to the present invention.

An assembly process of the illumination alert apparatus 4 entails coupling the body 1, the power unit 2, and the lightbulb 3 together, as shown in FIGS. 1, 3. Referring to FIG. 2, the assembly process of the illumination alert apparatus 4 comprises the steps of: nesting the power unit 2 in the coupling space 12 at one end of the body 1 (step 1); and meshing the thread segment 342 of the middle annular cover 34 at the bottom of the lightbulb 3 with the external thread 13 formed on an outward side of the body 1 and coupled to the power unit 2 (step 2).

Figure 4:
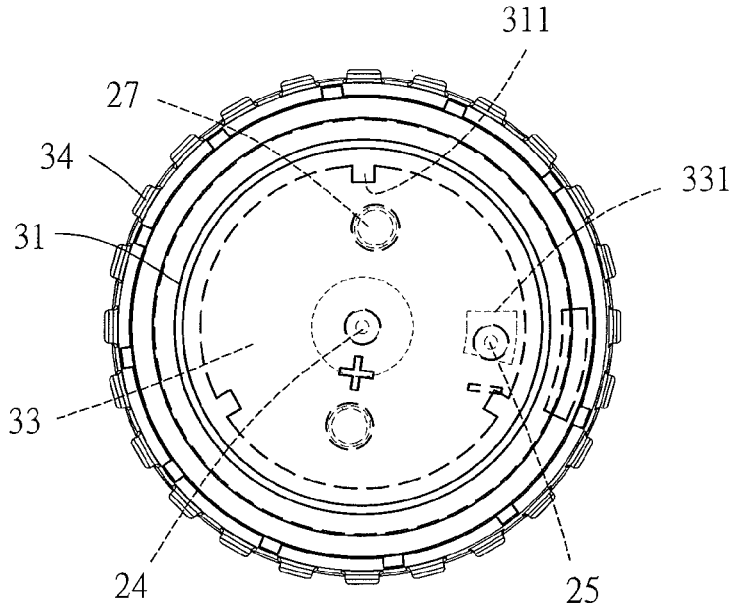
FIG. 4 is a top view of the illumination alert apparatus electrically turned on according to the present invention.
Figure 5:
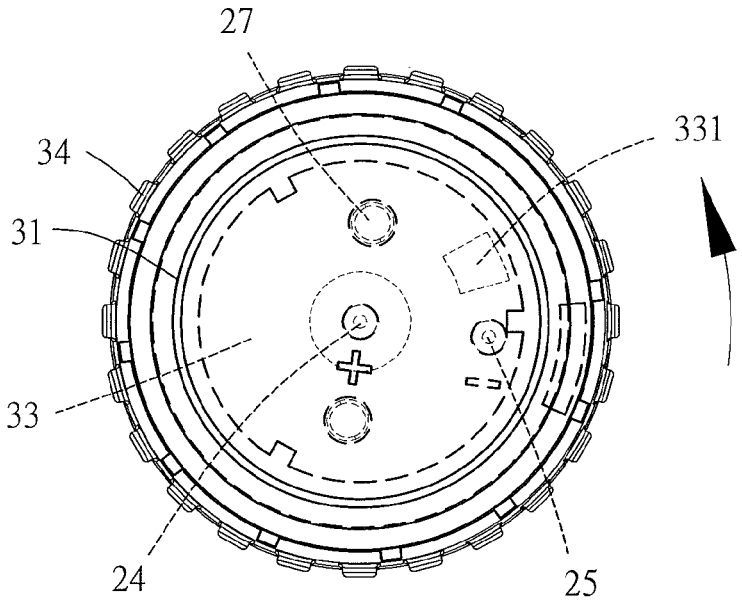
FIG. 5 is a top view of the illumination alert apparatus electrically turned off according to the present invention.

Referring to FIGS. 4, 5, the illumination unit 332 of the illumination alert apparatus 4 thus assembled is turned on or turned off in the way as follows: a user rotates the lightbulb 3 by hand to controllably turn on or turn off the power unit 2, by rotating the cap 31 of the lightbulb 3 to drive the plate 33 internally coupled thereto to undergo angular displacement, such that the copper sheet 331 on the active side of the plate 33 produces a power electrical connection ON state to turn on the illumination unit 332 (see FIG. 3) as soon as the copper sheet 331 rotates and reaches the negative pole conductive rod 25 of the power unit 2 as shown in FIG. 4. Hence, the illumination alert apparatus 4 in operation is capable of controllably driving the illumination unit 332 to be on or off by means of the cap 31.

Alternatively, the reverse rotation of the cap 31 of the lightbulb 3 in the opposite direction causes the plate 33 internally coupled thereto to undergo angular displacement, such that the copper sheet 331 on the active side of the plate 33 is separated from the negative pole conductive rod 25 of the power unit 2 as shown in FIG. 5, thereby bringing about a power electrical connection OFF state to turn off the illumination unit 332.

Figure 6:
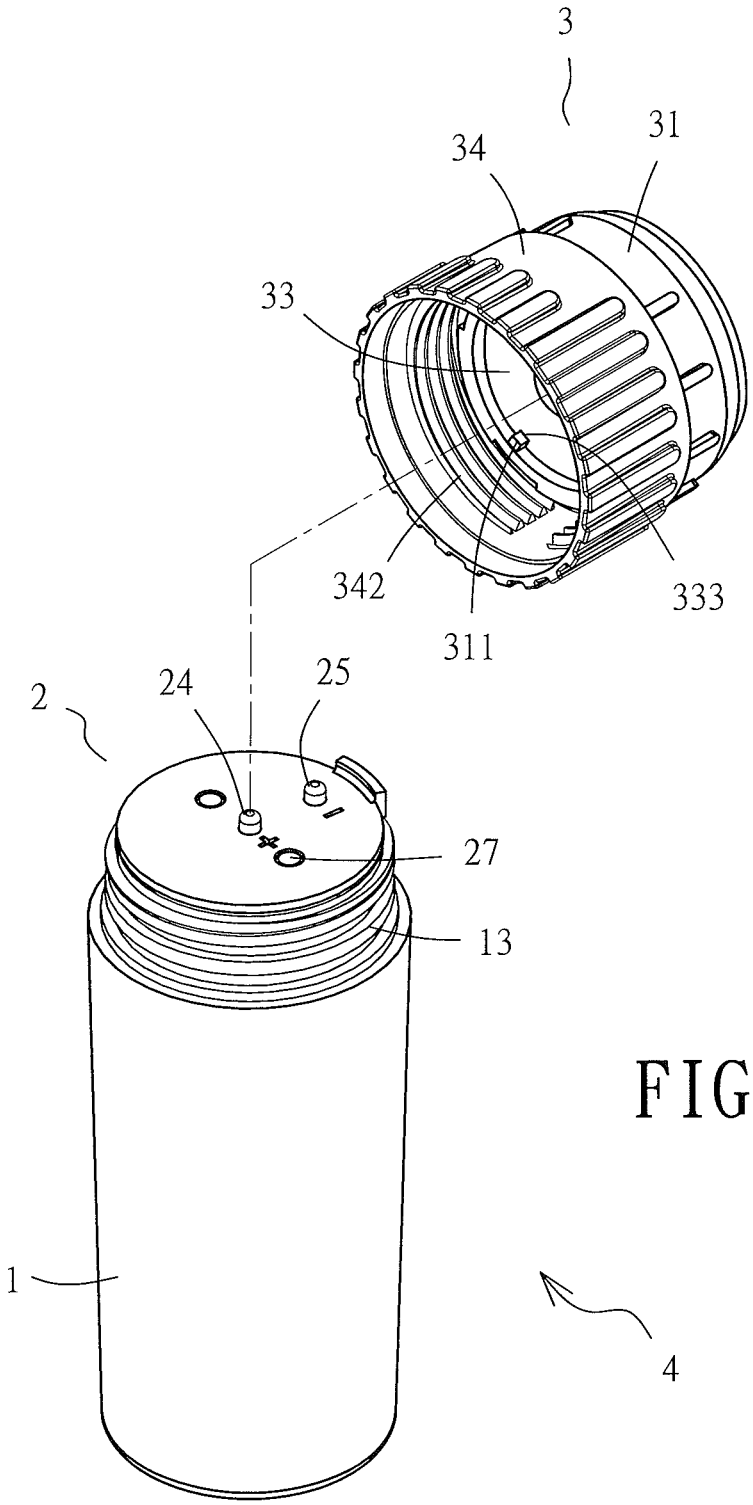
FIG. 6 is a schematic view of the illumination alert apparatus and a lightbulb removed from the top of the illumination alert apparatus according to the present invention.

To remove the lightbulb 3 coupled to the external thread 13 formed on an outward side of the body 1 and coupled to the power unit 2 of the illumination alert apparatus 4 as shown in FIG. 6, it is only necessary to rotate the middle annular cover 34 at the bottom of the lightbulb 3, such that the lightbulb 3 is separated from the corresponding end of the body 1 of the illumination alert apparatus 4, and the batteries 22 in the battery holder 21 can be changed.

What is claimed is:

1. An illumination alert apparatus structure having a cap for use in switch control, the illumination alert apparatus comprising:

a body;

a power unit; and a lightbulb having an illumination unit coupled thereto;

wherein the power unit is coupled to an end of the body, and the lightbulb is screwed to an external thread formed on an outward side of the body and coupled to the power unit, so as to assemble the illumination alert apparatus structure having a cap for controllably driving the illumination unit to be on or off;

wherein the power unit coupled to an end of the body comprises a battery holder for holding a plurality of batteries and a battery lid engageable with an end of the battery holder, wherein a preset orientation hole is penetratingly formed in the battery lid to allow positive and negative pole conductive rods to extend into the preset orientation hole, wherein springs abut against other ends of the positive and negative pole conductive rods, respectively, such that active ends of the springs abutting against the positive and negative pole conductive rods rest upon conductive elements of the battery holder, respectively, wherein the battery lid is fixed to the battery holder by at least one support element, wherein a stop portion protrudes from an outer rim of the battery lid, such that the stop portion abuts against an O-ring coupled to an inside of a middle annular cover at the bottom of the lightbulb to prevent the power unit coupled to one end of the body from rotating.

2. The illumination alert apparatus structure of claim 1, wherein the lightbulb screwed to the external thread formed on an outward side of the body and coupled to the power unit comprises a cap, a cup nested in the cap, and a plate, wherein a copper sheet is coupled to a preset position on an active side of the plate, and the illumination unit is centrally disposed at the plate, wherein a plurality of notches are disposed at rims of the plate and the cup and spaced apart, respectively, such that protrusion portions disposed at the rim of the cap can be inserted into the notches during an assembly process, wherein a flange is formed at an end of the cap for allowing the O-ring to be fixed in place, wherein the flange of the cap is inserted into a middle opening at a corresponding end of the middle annular cover, wherein orientation of the O-ring coupled to the end of the cap is subjected to restriction imposed by an inner margin of the middle opening of the middle annular cover, wherein a thread segment disposed on the inner wall of the middle annular cover is meshed with the external thread formed on an outward side of the body to enable engagement between the lightbulb and the body.

3. The illumination alert apparatus structure of claim 1, wherein the lightbulb coupled to the external thread formed on the outward side of the body and coupled to the power unit is rotated to controllably turn on or turn off the power unit, by rotating the cap of the lightbulb to drive the plate internally coupled thereto to undergo angular displacement, such that the copper sheet on an active side of the plate produces a power electrical connection ON state to turn on the illumination unit as soon as the copper sheet rotates and reaches the negative pole conductive rod of the power unit, wherein, alternatively, the copper sheet on the active side of the plate is separated from the negative pole conductive rod of the power unit, thereby bringing about a power electrical connection OFF state to turn off the illumination unit.

4. The illumination alert apparatus structure of claim 1, wherein, to remove the lightbulb coupled to the external thread formed on an outward side of the body and coupled to the power unit of the illumination alert apparatus, it is only necessary to rotate the middle annular cover at the bottom of the lightbulb, such that the lightbulb is separated from the corresponding end of the body of the illumination alert apparatus, and the batteries in the battery holder can be changed.

* * * * *